US005168645A

United States Patent [19]

Robin et al.

[11] Patent Number: 5,168,645

[45] Date of Patent: Dec. 8, 1992

[54] METHOD AND APPARATUS FOR AUTOMATICALLY GRASPING, SHAKING, SEPARATING, AND CONVEYING TWO ADJACENT CORNERS OF A FLAT SHEET

[76] Inventors: Francois Robin, 10 Cite Chabrol, 63000 Clermont-Ferrand, France; Francois Rabany, Chemnin des Golettes, Chevry-01170 GEX, France

[21] Appl. No.: 625,629

[22] Filed: Dec. 6, 1990

Related U.S. Application Data

[63] Continuation-in-part of Ser. No. 365,786, Jun. 14, 1989, abandoned.

[30] Foreign Application Priority Data

Jun. 16, 1988 [FR] France ..... 88 08079

[51] Int. Cl.[5] ..... D06F 67/04

[52] U.S. Cl. ..... 38/143; 38/7; 38/12; 198/465.4

[58] Field of Search ..... 38/7, 12, 143, 144; 198/383, 464.3, 465.1, 465.2, 465.4, 470.1, 471.1, 486.1; 271/4, 18, 8.1, 225, 228; 68/197, 264

[56] References Cited

U.S. PATENT DOCUMENTS

| | | | |
|---|---|---|---|
| 3,911,604 | 10/1975 | Stostrom | 38/143 |
| 4,313,269 | 2/1982 | Van Rumpt et al. | 38/143 |
| 4,774,505 | 9/1988 | Ueda et al. | 38/143 |

FOREIGN PATENT DOCUMENTS

| | | | |
|---|---|---|---|
| 0272368 | 6/1988 | European Pat. Off. . | |
| 2336510 | 10/1982 | France . | |
| 62-11100 | 9/1987 | Japan | 38/143 |
| 2219315 | 12/1989 | United Kingdom | 38/143 |

*Primary Examiner*—Werner H. Schroeder
*Assistant Examiner*—Ismael Izaguirre
*Attorney, Agent, or Firm*—Cushman, Darby & Cushman

[57] ABSTRACT

A method and a machine for automatically handling a flat rectangular sheet, located in a bin, which ultimately grasps two adjacent corners, allowing the rest of the sheet to hang freely, making the sheets ready to be dried, pressed and folded. First, the sheet is grasped in an arbitrary location and dragged until the farthest corner is found. Second, this corner is grasped by a gripper, which is attached to a rail, allowing the sheet to be dragged and shaken until the diagonal corner is located. Third, this diagonal corner is grasped by a second gripper. Fourth, the two remaining corners are separated through the use of a separation guide. Fifth, one of these remaining corners is grasped by a third gripper. Sixth, the first gripper is released. Finally, the sheet is moved, through the use of the second and third gripper attached to independent rails which finally become parallel, to a location where the sheet can hang freely from the two grippers attached to adjacent corners. The sheets are ready to be dried, pressed and folded.

13 Claims, 4 Drawing Sheets

1
2
3
4
5
6
7
8
9
10
11
12
13
14
21
22
24
25
26
27
28
29
30
31
32
33
34
35
36
A
B
C

METHOD AND APPARATUS FOR AUTOMATICALLY GRASPING, SHAKING, SEPARATING, AND CONVEYING TWO ADJACENT CORNERS OF A FLAT SHEET

CROSS-REFERENCE TO RELATED APPLICATIONS

This application is a continuation-in-part application of U.S. patent application Ser. No. 365,786, filed Jun. 14, 1989, which is now abandoned.

This application also claims the priority of French Application No. 88 08 079 filed Jun. 16, 1988, which is incorporated herein by reference.

BACKGROUND OF THE INVENTION

1. Field of the Invention

The present invention relates to a method and machine for automatically grasping two adjacent corners of a flat sheet. Such a machine is particularly suitable for operation in a laundry, after the washing phase and before the finishing phase of the flat sheet, for which phase the flat sheet must be presented while being grasped at its corners. In the finishing phase, the washed and wrung-out flat sheet, stretched between two of its adjacent corners, is engaged by a mangle that then drives it in order to dry it, press it and fold it automatically.

1. Description of the Related Art

In practice, finding the corners of a flat sheet must be done by hand, which is very labor-intensive and consequently increases the fixed costs for laundries. One system for automatically grasping flat sheets has already been described in French Patent 2336510. The system proposed there requires catching the flat sheet at four points in succession; the four points are a first point anywhere on the flat sheet, a first corner of the flat sheet comprising the lowermost point of the flat sheet suspended from the first arbitrary point, the corner of the flat diagonally opposite this first corner, and a second corner of the flat sheet adjacent to the first. Furthermore, the fact that the flat sheet is stretched between the first corner and the corner diagonally opposite it results in a machine of relatively great bulk, since the flat sheet is thus stretched on the diagonal, which is the longest distance between two points on a flat sheet. Finally, this system uses sets of detectors to find the second corner; accordingly, it must be possible for the closure of the grippers for grasping the flat sheet to be controlled at an undefined point, which is technically more difficult to accomplish than a system where closure of the grippers takes place at a fixed location.

The present invention provides a method which overcomes the foregoing disadvantages and which comprises the steps of gripping a first corner of a flat sheet after the sheet has been suspended and with the first corner being distanced from an arbitrary zone by a length greater than one-half the diagonal of the sheet. In a second step, a relative displacement by translation of the first corner while being gripped with respect to the gripping zone of the sheet is provided such that at least one of the two corners adjacent to the first corner comprises an apparent low point of the flat sheet stretched between the arbitrary gripping zone and the first corner. In a third step, the apparent low point is gripped and, in a fourth step, the portion gripped in a gripping zone is released. In the first step, the sheet is hung by gravity so as to allow a portion thereof to define the lowest point of the sheet and, in the second step, means are provided for shaking out the sheet and thereafter the sheet is positioned over a separation surface with the gripped portion and the first corner of the flat sheet disposed on either side of the separation surface.

The invention also includes apparatus for carrying out the steps of the method including a suction device for gripping the sheet during the first step and a detector to signal the passage of the lower most point of the flat sheet after a selected distance of travel. Translation paths defined by rails are provided for carrying the sheet through the subsequent steps.

Various alternative embodiments will become apparent as consideration is given to the following detailed description.

DESCRIPTION OF THE PREFERRED EMBODIMENT

Figure 1:
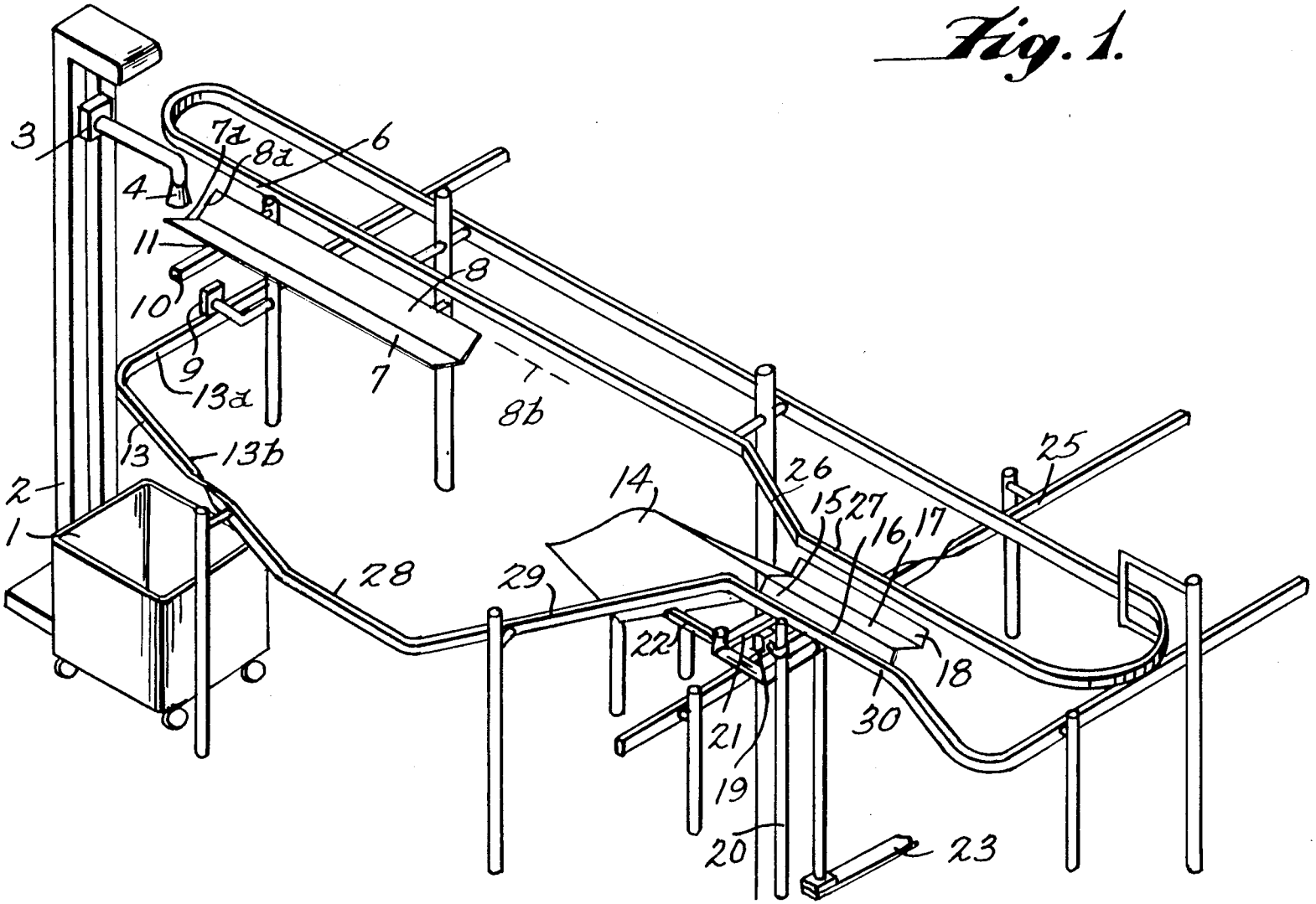
FIG. 1 is a schematic view of one embodiment according to the invention.

Referring to the drawings, the machine can be seen to include a suction cup in which there is a depression for gripping a flat sheet by suction in a carriage 1 that contains a plurality of flat sheets. Next, an arm 3 attached to the suction cup 4 and being displaced by vertical translation with respect to an immobile frame 2 lifts the thus gripped flat sheet up to a fixed height greater than the length of the diagonal of the flat sheet.

Figure 4:
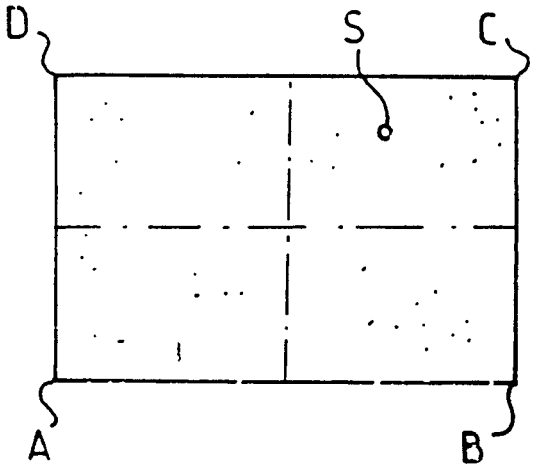
FIG. 4 is a schematic view showing a flat sheet in plan view and gripping zone for the suction cup.

Referring to FIG. 4, there is shown a point S where the suction cup 4 grips the flat sheet which, normally, is folded loose in the carriage 1 but which has been represented as flat to simplify the illustration. The point S will be located in one of the four squares determined partially by the median line between the long and short sides of the flat sheet. The other point of the sheet which will be gripped as explained below, in the first stage, is the first corner A spaced from the point S by a length greater than one half the diagonal of the flat sheet. The point A is defined by the farthest point from point S lying in the partial rectangle opposite to that which contains the point S.

Just below the level at which the suction cup 4 stops during its vertical translation, there is situated a horizontal rail 6 and which extends rectilinearly a distance greater than the length of the diagonal of the flat sheet beginning at the frame 2.

Two identical longitudinally extending plates 7 and 8 having a common edge extending parallel to their axes, form a V shaped receptacle opening upwardly. These plates 7, 8 are disposed parallel to the rail 6, at a height slightly less than the rail 6. The small edges 7*a*, 8*a* of the plate 7 and 8 facing towards the frame 2 are situated near the vertical trajectory of the suction cup, at a distance from that trajectory such that the suction cup is able to pass close to the two plate 7 and 8 without being caught on them.

The two plates 7 and 8 are fixedly connected to each other and are supported in a manner to allow pivoting, together, about an axis 8*b* extending along the long exterior edge of the plate 8, which is closest to the rail 6. The pivoting operation is effected by a suitable device such as an air cylinder or a screw jack which is not shown in the drawing but is arranged as the cylinder in FIG. 11.

A detector 9, which is preferably a photoelectric detector, is placed slightly below the point where the edges 7*a* and 8*a* intersect in order to detect the presence of a flat sheet as the sheet passes in front of the detector.

Figure 6:
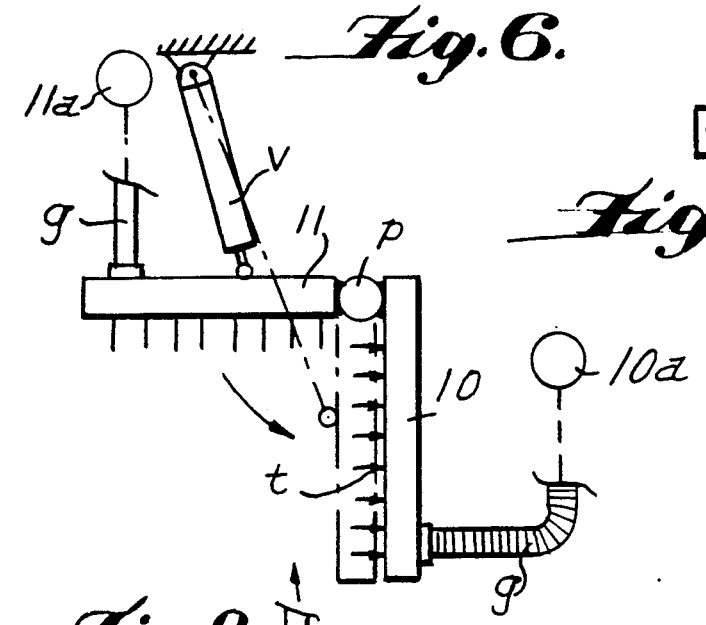
FIG. 6 is a plan view showing the blower nozzle and the suction member and the pivoting mechanism.

A suction pipe 10 is disposed to extend horizontally above the detector 9 between the detector and the intersection formed by the edges of the plate 7 and 8. The suction pipe 10 is formed as shown in FIG. 6 by a tubular element which is closed at its axial ends and has a transverse square or rectangular cross-section and which has a surface facing towards the frame 2 and is provided with at least one set of openings t. The interior volume of the pipe 10 is connected by a flexible conduit g to a vacuum pump operated by an electric motor 10*a*. The face of the pipe 10 provided with the holes t is disposed in the vertical plane passing through the intersection of edges 7*a*, 8*a* of the plate 7 and 8.

A blower nozzle 11 is disposed in the same horizontal plane as the pipe 10. The nozzle 11 is articulated on a pivot axis p (FIG. 6) which is fixedly connected to the pipe 10. The nozzle 11 is formed similarly to the pipe 10 by means of a tubular element of which the face is located to the side of the pipe 10 and is furnished with at least a row of holes t. The nozzle 11 is connected by a flexible conduit g to a blower operated by an electric motor 11*a*. The pivoting of the nozzle 11 is effected by a piston and cylinder arrangement V which may be hydraulic or air operated. In the opened position, the nozzle 11 makes an angle of 90° with the pipe 10 while in the closed position the nozzle 11, as shown in the broken lines in FIG. 6, is applied against the pipe 10.

A horizontal rail 13 is disposed below the pipe 10 and includes a section 13*a* parallel to the pipe 10 and situated in the vertical plane of the pipe with the section 13*b* forming an elbow or bent section followed by a section 28 of which the length is for example on the order of one meter. At the end of the portion 28, the rail 13 is bent or curved in a manner to approach the rail 6 following portion 29 the bends in the rails 13 and 6 act to shake the gripped flat sheet. The rail 6 is itself bent in the manner to approach the rail 13, following a section 26. The sections 29, 26 approach at a distance of approximately 10 cm where the rail 6 and 13 return parallel on their respective sections 27 and 30.

Figure 3:
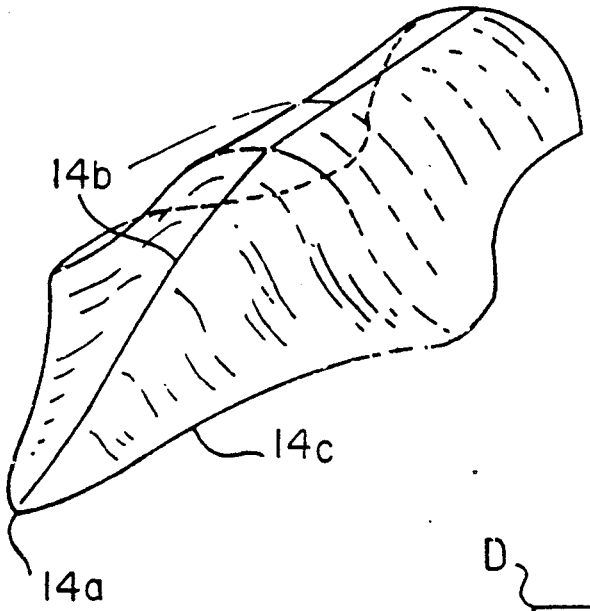
FIG. 3 is a schematic view in perspective of a separation guide viewed from the front.

A separation guide 14 (FIG. 3) is placed between the rail 6 and 13 at their sections 26, 29. The guide 14 is symmetrical with respect to a vertical plane equidistant from the sections 27 and 30. The guide 14 is formed by two symmetrical plates joined together along an upper edge 14*a*, 14*b*, situated in the vertical plane of symmetry. The point 14*a* of the guide 14 at the leading edge of the two plates is situated at a vertical distance from the rail 6 greater than the length of the small side of a flat sheet. As one progresses along the length of the guide 14, the intersection or joining ridge 14*b* rises and approaches vertically the rail 6 while remaining below it. The lower edge 14*c* blends at the point 14*a* of the guide with the upper joining edges but spaced from the vertical plane of symmetry while extending horizontally and follows a concave curve. A leading portion of the guide 14 is therefore formed and situated in advance of the rail sections 26 and 29. A second portion of the guide 14 is situated directly between the sections 26 and 29. In the second section, the upper ridge 14*b* extends horizontally in the vertical plane of symmetry whereas the lower ridge or edge 14*c* remains in the horizontal plane and extends along a convex curve followed by a concave section as it nears the vertical plane of symmetry as shown in FIG. 3.

Figure 2:
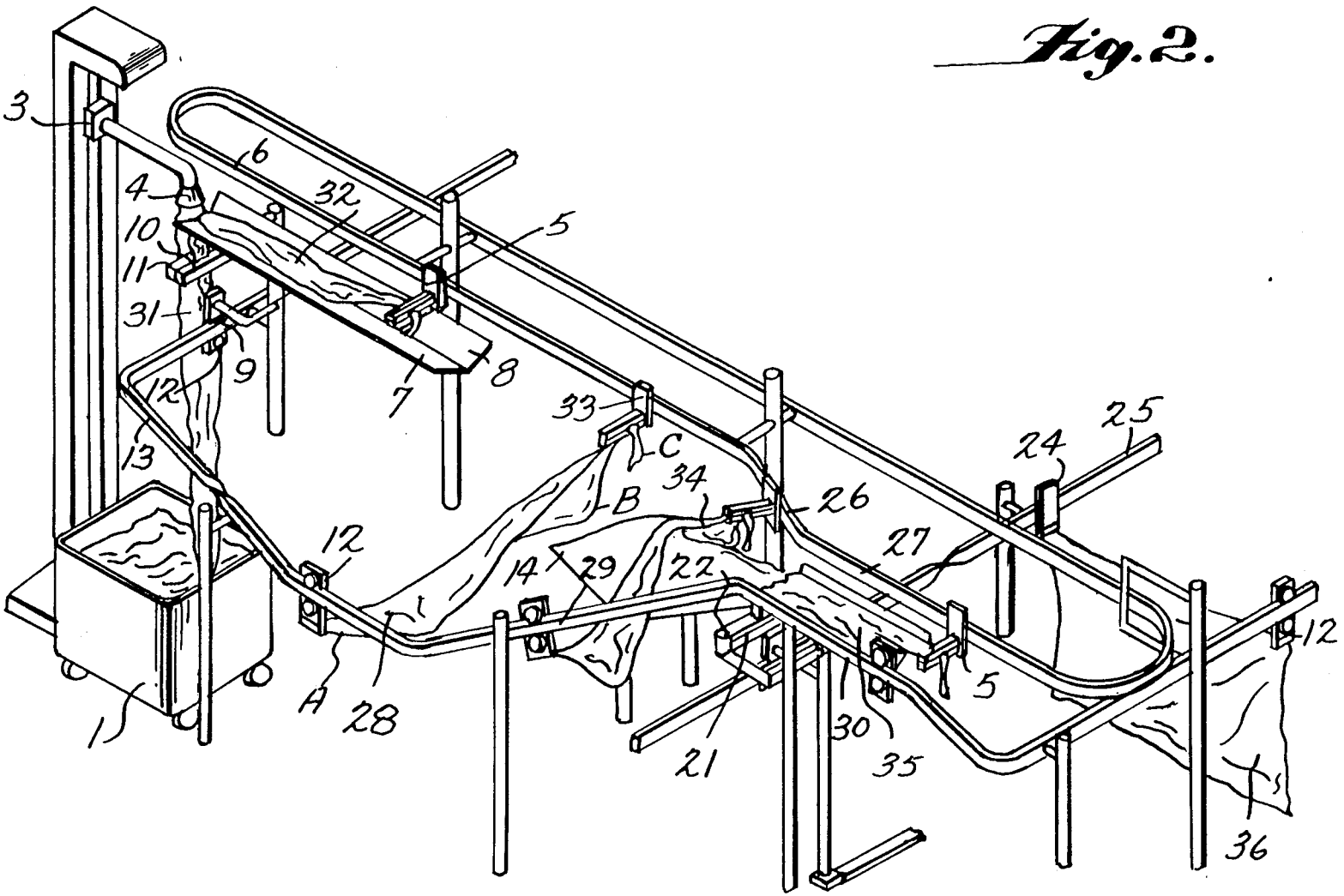
FIG. 2 is a schematic view of the embodiment of FIG. 1, showing several flat sheets in the course of being laundered.
Figure 11:
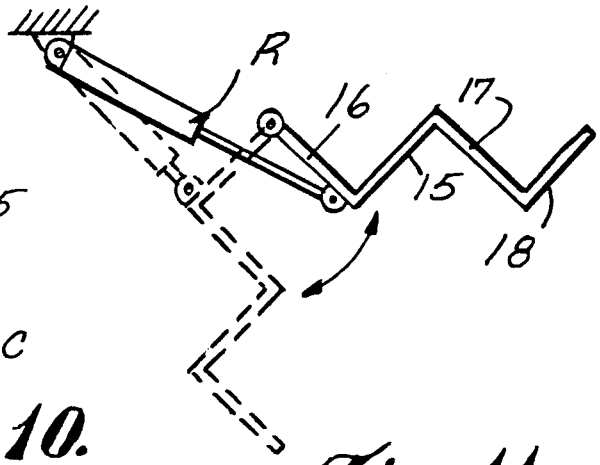
FIG. 11 is a schematic illustration of the pivoting structure of the support plates located downstream of the separation guide.

Four plates 15, 16 and 17 and 18, each pair being identical to the plates 7 and 8, are disposed between the sections of rail 30 and 27 downstream of the guide 14. The plates 15 or 16 are placed between the two rails 6 and 13 and parallel to these rails in a manner such that the exterior edges of the plate 15, the one closest to the rail 6 will be an extension of the upper ridge 14*b* of the guide 14. The dihidral intersection formed by the two plates 17, 18 is located on the other side of the ridge 14*b* relative to the dihedral surface formed by the two plates 15 and 16. With this arrangement, the transverse section of the assembly of plates 15 to 18 relative to a vertical orthogonal plane to the sections 27 and 30 forms a W; these plates are connected one to the other and the assembly is able to pivot around an axis which extends along the upper external edge of the plate 16 as shown in FIG. 11. The operation of the pivoting downwardly of the assembly of plates is effected by a piston and cylinder R. This swinging movement from the vertical downwardly around the upper edge of the plate 16 opens the space between the sections 27 and 30 for the releasing of the flat sheet as illustrated in FIG. 2.

A detector 19 is provided at the level of the vertical plane which passes through the upstream ends of the plates 15 to 18. Preferably the detector is of the photoelectric type similar to detector 9 and is mounted on a support 20 and may be situated slightly below the upstream ends of the surface edges of the plates 15 and 16 and plates 17 and 18. The support 20 may be of the type that is movable for example, manually in a direction orthogonal to the sections 27 and 30 so as to place the detector either in the vertical plane of the edge of the plates 15 and 16 or in the vertical plane of the edges of the plate 17 and 18. The detector 19 will serve to detect the presence of a sheet by changing the amount of light falling on the detector.

A suction pipe 21 similar to pipe 10 is fixed on the support 20 and extends horizontally in a vertical plane passing through the upstream ends of the plates 15 to 18. The pipe 21 is placed above the detector 19 between the detector and the plates.

A blower nozzle 22 is disposed in the horizontal plane of the pipe 21 and is articulated on a pivot pin fixed on the pipe 21 in the same manner as the blower 11 shown in FIG. 6. The pivoting of the blower 22 is effected by a piston and cylinder similar to the piston and cylinder V of FIG. 6. In the open position, the blower 22 makes an angle of 90° with the pipe 21. In the closed position, the blower 22 and the pipe 21 constitute a secure gripper at a vertical point on the extreme upstream edge of the plates 15–18.

Movement of the support 20 is guided by a rail 23 fixed to the ground or base.

A horizontal rail 25 extending perpendicular to the edges of the plates 15, 16 and 17, 18 is disposed slightly below the pipe 21. The operation of the apparatus thus far described now will be set forth.

A carriage 1 filled with flat loose sheets is disposed below the arm 3 and the suction cup 4.

Figure 7:
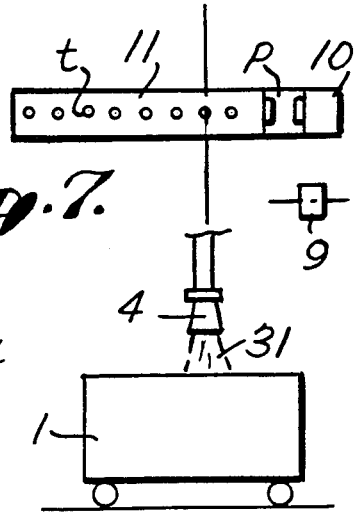
FIGS. 7 to 10 are schematic illustrations of the successive stages of the position of the flat loose sheet and of the raising of the sheet at the detection of the lowest point thereof.

The arm 3 is caused to descend to where the suction cup 4 comes into contact against a sheet in the carriage 1. The suction cup is then connected to a vacuum source and the arm 3 is raised whereby a sheet held at a point S is lifted by the suction cup 4 as shown in FIGS. 2 and 7.

Then with the raising of the arm 3, when the detector 9 detects the passing of the sheet before it, the detector 9 causes a signal to be sent along a suitable cable to the motor for the suction pipe 10 so that the sheet will be grasped and be held against the pipe 10.

The raising of the arm 3 continues up to the end of its path defined by the support bracket on which the arm is movably mounted.

Figure 8:
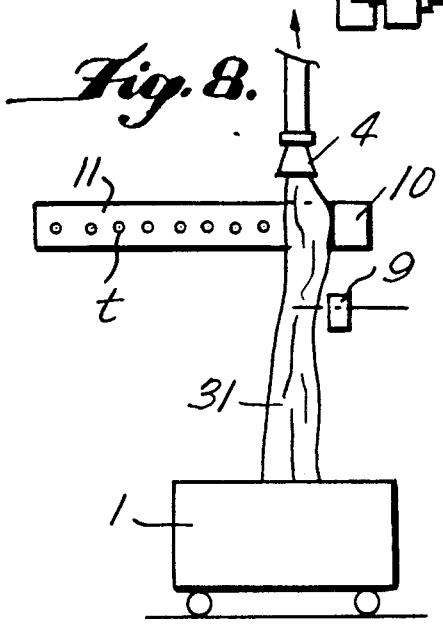

A gripper 5 is then operated to move on the rail 6 and comes to grip the sheet in the vicinity of the zone S slightly below the suction cup 4 in the position as illustrated in FIG. 8.

The suction cup 4 is then isolated from the vacuum source so as to allow the sheet and the gripper 5 to continue to advance the length of rail 6 while drawing the sheet into the groove defined by plates 7 and 8.

Figure 9:
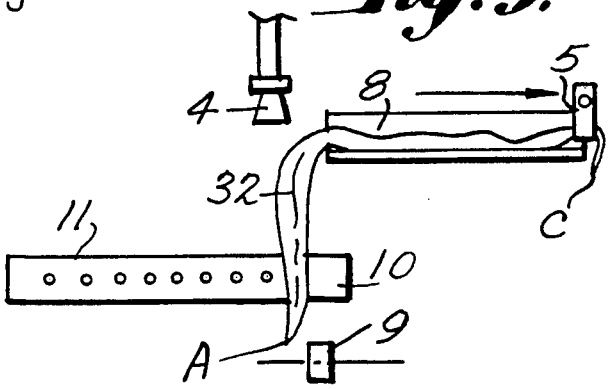
Figure 10:
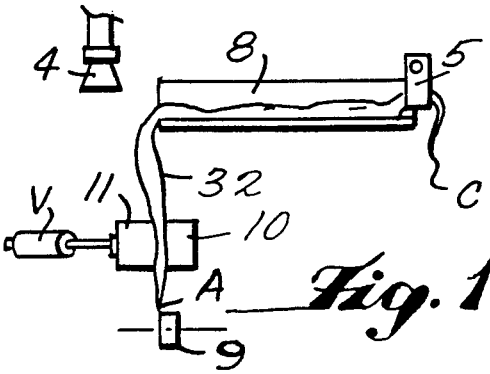

The lower extremity of the sheet, which corresponds to a corner A continues to rise as shown in FIG. 9. When the corner A has passed by detector 9, the detector 9 will cease to detect the sheet and will then cause:

The arrest of gripper 5;

The pivoting of the blower 11 against the suction pipe 10 as shown in FIG. 6 in a manner so as to grip the corner of the sheet between the pipe 10 and the blower 11;

Operation of the blower motor feeding the nozzle 11;

The effect of the blown air by the nozzle 11 is to permit a better contact on the suction pipe 10, notably a contact sufficient to draw the corner A against the pipe 10;

The gripping of the corner A after an interval by a gripper 12 travelling on the rail 13.

The pivoting of the plate 7 and 8 toward downwardly around the pivot axis **8*b* is accomplished as described above to free the sheet 32 and the movement of the gripper 12 is effected up to a position substantially in an orthogonal plane relative to the direction of the rail 6 passing by the gripper 5** which is still stopped.

Figure 5:
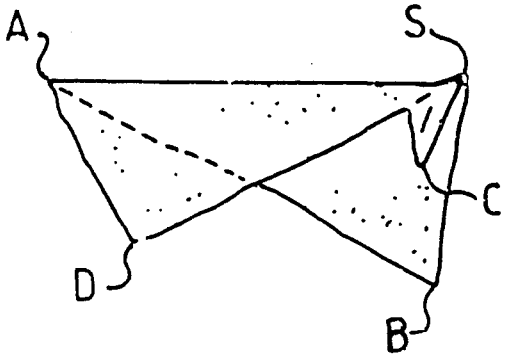
FIG. 5 is a schematic view in elevation of a flat sheet while being transported gripped between a point corresponding substantially to the gripping zone for the suction cup and a corner of the sheet.

Subsequently, the simultaneous movement of the two grippers 5 and 12 is started both at the same speed. The grippers grip the sheet in the manner as shown in FIG. 5. It will noted that the gripper 12 passes through a twisting path of 180° due to the fact of the bend in the rail 13 which causes the corner A held by the gripper to be positioned under the rail 13 after traversing this path. This 180 degree bend and the other bends in the tract act to shake the sheet so as to aid and deploying to apparent low points B and D. Grippers 5 and 12 are spaced approximately one half the diagonal of the sheet. This provides two apparent low points B and D of the sheet corresponding to the two opposed corners of the sheet (see FIGS. 4 and 5).

While advancing, the grippers 5 and 12 carry the sheet in this configuration adjacent the point **14*a* of the guide 14** which separates the corners B and D of the sheet.

The grippers 5 and 12 continue to advance by dragging the sheet onto the plates 15, 16 (the corner D coming to be displaced substantially to follow the ridge of the two plates) and on plates 17, 18, the corner B being displaced substantially following the ridge of these two plates.

If one wishes to grip a long side of the sheet, that is the side between points A and B (FIG. 4), one displaces the support 20 and its rail 23 in order to position the detector, the suction pipe 21 and the blower 22 below the edge of the plates 17 and 18.

If one wishes to grip a small side between points A and D of the sheet, one displaces the support 20 in order to position the detector 19, the pipe 21 and the blower 22 below the edge of the plates 15, 16.

The detector 19 can detect the passage of the low point corresponding to B or D on which gripping is to be effected.

Upon the passage of the corner by the detector 19, as described above in connection with detector 9, a signal which is generated by the detector will break the circuit to the motor driving grippers 5 and 12 to stop the grippers 5 and 12 which will then be located on the rail sections 27 and 30. The closing of the blower nozzle 22 against the suction pipe 21 is effected in the same manner as the operation of the nozzle 11 relative to the pipe 10, relative to the corner, either B or D, which has been gripped.

The movement of the gripper 24, displaced on the rail 25, is effected and the gripper 24 grips the corner B or D below the pipe 21 and the blower 22. Opening of the blower nozzle 22 is then effected at the same time as the opening of the gripper 5, which faces the adjacent zone S of the sheet.

The sheet is then maintained at the level of corner A by the gripper 12 and at the level of corner B or D by the gripper 24.

The pivoting of the plates 15, 16, 17, 18 about the upper ridge of the plate 16 is effected in a manner to permit the sheet to be disposed as illustrated in FIG. 2.

After the pivoting of the plates 15, 18, the gripper 12 is set in motion to become situated substantially in an orthogonal plane of the rail 25 and passing by the gripper 24.

At this time, the gripper 24 is operated at the same speed as the gripper 12 and the sheet is transported as illustrated at 36 in FIG. 2.

FIG. 2 represents several sheets at different stages of treatment. Numeral 31 designates a sheet which has just been gripped at some point S by the suction cup 4.

Numeral 32 designates a sheet at the moment where it is gripped by the gripper 5 and pulled so that it will rest on the plates 7 and 8.

Numeral 32 indicates a sheet when it is maintained in the condition shown in FIG. 5 with the apparent low points B and D indicated.

The reference numeral 34 designates a sheet upon its passage over the separation guide 14. Numeral 35 designates the sheet at the moment of gripping of the corner B or D by a gripper 24.

Finally numeral 36 designates a sheet at the moment where it is being lead away by the grippers 12 and 24 which holds each set of adjacent corners A, B or A, D of the sheet.

Having described the invention, it will be apparent to those skilled in the art that various modifications may be made thereto without departing from the spirit and scope of this invention as defined in appended claims.

What is claimed is:

1. A method for automatically handling a flat rectangular sheet having four corners with a predetermined diagonal length between two opposite ones of said four corners, comprising, as a first step, grasping the sheet at a first arbitrary zone thereof and at a first one of said corners with the distance between said first one of said corners and the arbitrary zone being greater than one-half said diagonal length of the sheet; then, as a second step, displacing said first one of said corners away from the first arbitrary zone to stretch the sheet between the first arbitrary zone and the first one of said corners in such a way that another of said corners adjacent said first one hangs downwardly relative to the remainder of the sheet; moving the sheet over a separation means having an upwardly sloping portion with the first one of said corners and the first arbitrary zone disposed on opposite sides of said separating means so as to separate the downwardly hanging corner from the remainder of the sheet and, as a third step, grasping said downwardly hanging corner; and as a fourth step, releasing the first arbitrary zone.

2. The method as defined by claim 1, wherein, in the second step, a shaking means shakes the sheet which is suspended by the gripping means (12 and 5) in order to have said another of said corners adjacent to said first one hang downwardly.

3. The method as claimed in claim 1 wherein the first arbitrary zone of the flat sheet is grasped by catching means, said zone having a reduced surface area about a point, and including the steps of suspending the grasped flat sheet from said catching means so as to hang by gravity, locating the lowest point of the suspended sheet and gripping said lowest point with gripping means.

4. The method as claimed in claim 3 wherein, in the first step, the first one of said corners is gripped by gripping means.

5. The method as claimed in claim 1 wherein a first and second spaced apart centering means are provided and including the steps of, prior to said displacing step, drawing the first arbitrary zone over the first centering means and then effecting said displacing step including moving the sheet so as to extend substantially at a right angle to the first centering means, the second centering means being located after the separation means and including the step of drawing the sheet over the second centering means subsequent to passage over the separation means so that a portion of the sheet hangs vertically downward, and including the steps of detecting and stopping the movement of said portion, and the step of grasping said portion.

6. The method as claimed in claim 5, wherein, before grasping said portion of the sheet, pressing said portion against a suction element by exposing said portion to a jet of air.

7. A machine for handling a flat rectangular sheet having four corners with a predetermined diagonal length between two opposite ones of said corners, comprising catching means for grasping a first arbitrary zone of the sheet, means for vertically raising said catching means so that the sheet carried thereby hangs from the catching means vertically downwardly forming a lower portion, sheet conveying means including a first path having gripping means movable on said first path for subsequent gripping and conveying of said first arbitrary zone, detecting means for detecting passage of the lower portion of the sheet as the sheet is raised toward said conveying means, said conveying means including a second path separate from said first path, said second path having gripping means movable thereon for gripping the lower portion of the sheet, said conveying means displacing both said gripping means along said respective paths and with respect to each other and said paths being disposed divergently at least along a portion thereof so that the sheet is extended between said paths, separating means disposed along another portion of said paths and between said paths so as to intercept the extended sheet during displacement thereof for separation of one of said corners from the remainder of the sheet, said conveying means including a third path separate from said first and second paths and including another gripping means movable on said third path for gripping said one of said corners after passage of the sheet past said separating means.

8. The machine as claimed in claim 7 including means for shaking the sheet by acting on both said gripping means while one gripping means grips the first arbitrary zone of the sheet and the other gripping means grips the lower portion of the sheet.

9. A machine for handling a flat, rectangular sheet having four corners with a predetermined diagonal length between two opposite ones of said corners, comprising catching means for grasping a first arbitrary zone of the sheet, means for vertically raising said catching means so that the sheet carried thereby hangs from the catching means vertically downwardly and includes a lower portion, sheet conveying means including a first path having gripping means movable on said first path for susequent gripping and conveying of said first arbitrary zone, detecting means for detecting passage of the lower portion of the sheet as the sheet is raised toward said conveying means, said conveying means including a second path separate from said first path, said second path having gripping means movable thereon for gripping the lower portion of the sheet, said conveying means displacing both said gripping means along said respective paths and with respect to each other with said paths being disposed divergently at least along portions thereof so that the sheet is extended between said paths, said machine including means for shaking the sheet by acting on both said gripping means while one gripping means grips the first arbitrary zone of the sheet and the other gripping means grips the lower portion of the sheet.

10. The machine as claimed in claim 9 wherein separating means is provided disposed along another portion of said paths and between said paths so as to intercept the extended sheet during displacement thereof for separation of at least one of said corners from the remainder of the sheet.

11. The machine as claimed in claim 7 or 9 wherein at least one sheet centering means is provided along said paths adjacent to said detecting means and said conveying means and wherein the sheet is displaced at a right angle to said centering means.

12. The machine as claimed in claim 7 or 9 further including a suction nozzle and an air blowing nozzle with the suction nozzle being movable toward the air blowing nozzle to grip the sheet when said detecting means detects the lower portion of the sheet.

13. The machine as claimed in claim 7 or 9 wherein said conveying means comprises a plurality of rails, both said gripping means including two wheels engaging a respective rail for displacement of both said gripping means on said respective rails.

* * * * *